US006648460B2

(12) United States Patent
Gonzales

(10) Patent No.: US 6,648,460 B2
(45) Date of Patent: Nov. 18, 2003

(54) HIGH VOLUMETRIC EFFICIENCY INK CONTAINER VESSEL

(75) Inventor: Curt G. Gonzales, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/060,821

(22) Filed: Jan. 30, 2002

(65) Prior Publication Data

US 2003/0142180 A1 Jul. 31, 2003

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 5,146,243 A 9/1992 English et al. ..... 346/140
5,600,358 A 2/1997 Baldwin et al. ..... 347/87
5,956,054 A 9/1999 Hirabayashi et al. ..... 347/37
6,086,193 A * 7/2000 Shimada et al. ..... 347/86
6,231,173 B1 5/2001 Pawlowski, Jr. et al. ..... 347/86
6,276,788 B1 8/2001 Hilton ..... 347/86
6,286,944 B1 9/2001 Shimizu et al. ..... 347/86
6,286,945 B1 9/2001 Higuma et al. ..... 347/86
6,494,568 B2 * 12/2002 Hou et al. ..... 347/86

* cited by examiner

*Primary Examiner*—Anh T. N. Vo

(57) ABSTRACT

A printing system includes a high volumetric efficient free-ink container vessel. The vessel includes a reservoir to store a supply of ink. A vent hole in the reservoir links atmospheric air to the reservoir. A mechanical vent system selectively opens and closes the vent hole in the reservoir. The mechanical vent system is equipped with a movable member that moves between a closed position covering the vent hole and an open position uncovering the vent hole. The mechanical vent system moves the movable member to open and close the vent hole. When the vent hole is open, non-atmospheric pressures imparted within the reservoir can be virtually eliminated by the exemplary mechanical vent system.

20 Claims, 6 Drawing Sheets

HIGH VOLUMETRIC EFFICIENCY INK CONTAINER VESSEL

BACKGROUND

The present invention relates to printing systems, and more particularly, to printing systems that make use of ink container vessels for delivery of ink to printing delivery systems.

Printing systems, such as ink-jet printing systems, typically use ink container vessels. Most ink container vessels used in popular printing systems today deploy some type of sold material within their reservoirs such as porous material or collapsible film. The porous material and/or collapsible films are used in the vessel containers to provide a means of preventing ink from leaking out of vents in the containers and to provide backpressure for the ink delivery system. These solid parts also prevent spillage of ink through vent holes of the container vessels during shipment and handling of them.

Such ink container vessels are typically purchased prefilled with ink and are discarded after they run out of available ink. A serious drawback of such vessels, however, is that they often strand between 15% and 50% of their initial total fill of ink after depleting available ink for the printing system. "Strand" means that ink remains in the container vessels when they are discarded, because the ink cannot be accessed by the printing system. In other words, most current ink container vessels permanently leave behind up to half their initial volume of total ink in the vessel when the container needs to be discarded. Ink becomes trapped and lodged in nooks of the container to become permanently stranded and/or becomes trapped in porous materials used inside a vessel to retain the ink.

Moreover, volumetric efficiency of an ink supply container vessel suffers because of the presence of solid materials throughout the reservoir of a vessel. Such solid parts fill volume that may otherwise be used to store ink. Additionally, printer manufacturers often construct ink container vessels with larger volumetric ink capacities in order to compensate for the stranding of large percentages of ink. Unfortunately, larger vessels also increase the total size of printer products, because printer systems must be able to accommodate these larger vessels. Larger vessels also require higher initial fill volumes of ink, which is costly.

Furthermore, many current ink container vessels are also environmentally unfriendly; because they often cannot be easily recycled due to the amount of stranded ink left in the vessels once they have to be discarded (i.e., once there is no available ink for printing).

Still another problem associated with many current ink container vessels is the fluctuation of pressures within the container's reservoir. It is common for ink container vessels to be exposed to temperature and altitude variations, which causes air volume within the reservoir to expand or contract. Such pressure variations have a negative impact on ink delivery systems, because it skews the consistency of ink flow delivered to printing media. Air expansion in a closed ink container may cause ink to be pushed out of the ink delivery system forcing ink to leak out of the system. Vessels that use solid materials in the reservoir impart flow restrictions on ink (in addition to trapping ink as described above), which also affects the quality of ink delivery systems and limits the types of ink delivery systems that can be used in combination with such vessels.

SUMMARY OF THE INVENTION

Exemplary embodiments of the present invention comprise high volumetric efficient free-ink container vessels.

The vessels include a reservoir to store a supply of ink. A vent hole in the reservoir links atmospheric air to the reservoir. A mechanical vent system selectively opens and closes the vent hole in the reservoir. The mechanical vent system is equipped with a movable member that moves between a closed position covering the vent hole and an open position uncovering the vent hole. The mechanical vent system moves the movable member to open and close the vent hole. When the vent hole is open, non-atmospheric pressures imparted within the reservoir can be virtually eliminated by the exemplary mechanical vent system.

The exemplary high volumetric efficiency ink container described herein, therefore, introduces the broad concept of employing a mechanical vent system that imposes no pressure effects on the ink delivery system. The vent system is able to open the supply of air to the interior of the vessel when the vessel is inserted into the printer and close the supply of air when removed from the printer. Additionally, the vent system is able to open/close the vent hole at prescribed times. The exemplary high volumetric efficiency ink container of the present invention also allows positioning of the fluid interconnect port at substantially the lowest point of fluid reservoir, resulting in only a small residual portion of ink being stranded in ink container vessels when the ink supply is depleted. Furthermore, the vessel may be used with a wide variety of ink delivery systems, since there are no pressurized effects caused by the vessel.

BRIEF DESCRIPTION OF THE DRAWINGS

The detailed description is described with reference to the accompanying figures. In the figures, the left-most digit(s) of a reference number identifies the figure in which the reference number first appears.

DETAILED DESCRIPTION

Figure 1:
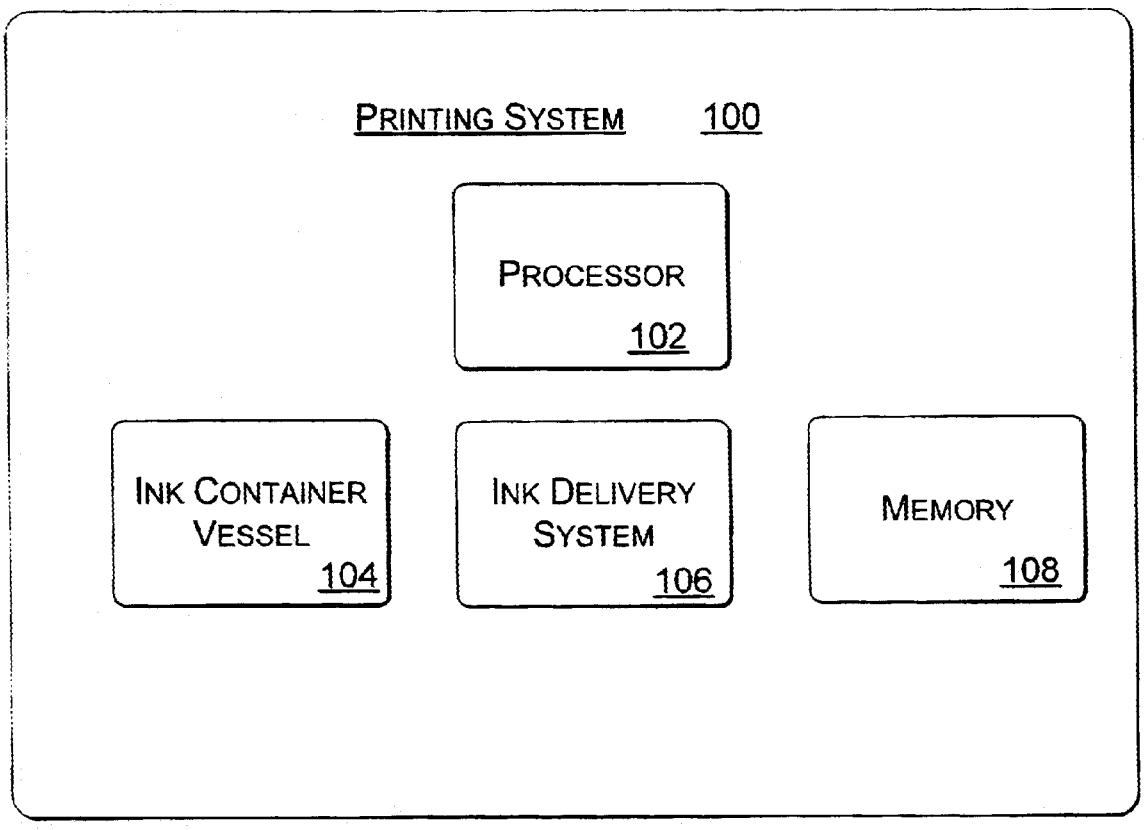
FIG. 1 is a simplified block diagram of an exemplary ink-jet printing system that can be utilized to implement.

FIG. 1 is a simplified block diagram of an exemplary ink-jet printing system 100. As used herein, "printing system" means any electronic device having data communications, data storage capabilities, and/or functions to render printed characters and images on a print media. A printing system may be a printer, fax machine, copier, plotter, and the like. The term "printing system" includes any type of printing device using a transferred imaging medium, such as ejected ink, to create an image on a print media. Examples of such a printer can include, but are not limited to, inkjet printers, plotters, portable printing devices, as well as multi-function combination devices. Although specific examples may refer to one or more of these printers, such examples are not meant to limit the scope of the claims or the description, but are meant to provide a specific understanding of the described implementations.

Printing system 100 includes one or more of the following: a processor 102, an ink container vessel 104, an ink delivery system 106 and memory 108. Additionally, although not shown, a system bus as well as mechanical connections, such as fluid interconnects, typically connects the various components within printing system 100.

Processor 102 processes various instructions to control the operation of system 100 and to communicate with other electronic and computing devices. Essentially processor 102 manages the overall operation of printing system 100. Memory 108 is used to store instructions and messages useful for processor 102 to manage operation of system 100, including communicating with other devices. Memory 108 may include programmable and/or permanent storage of data and instructions. Various types of memory devices, depending on the complexity of system 100, may be deployed.

Ink container vessel 104 stores a supply of ink for the printing system 100. As used herein, vessel 104 may also be referred to as an ink container vessel or a printer cartridge. Vessel 104 shall be described in more detail below, with reference to FIGS. 2–6. Ink delivery system 106 is typically connected to ink container vessel 104 by flexible tubing conduit or hollow needle (tubing and needle not shown but well understood by those skilled in the art). System 106 selectively extracts ink stored in vessel 104 and deposits the ink on media (not shown). Ink delivery system 106 can include an inkjet printing mechanism that selectively causes ink to be applied to a print media in a controlled fashion. It should be noted, however, that the exemplary ink delivery system 106 used with the ink container vessel of the present invention is a Spring-bag regulator system. However, there are many different types of ink delivery systems 106 available, such as Foam or other capillary material. For discussion purposes ink delivery system 106 can include any of these different types of systems.

Figure 2:
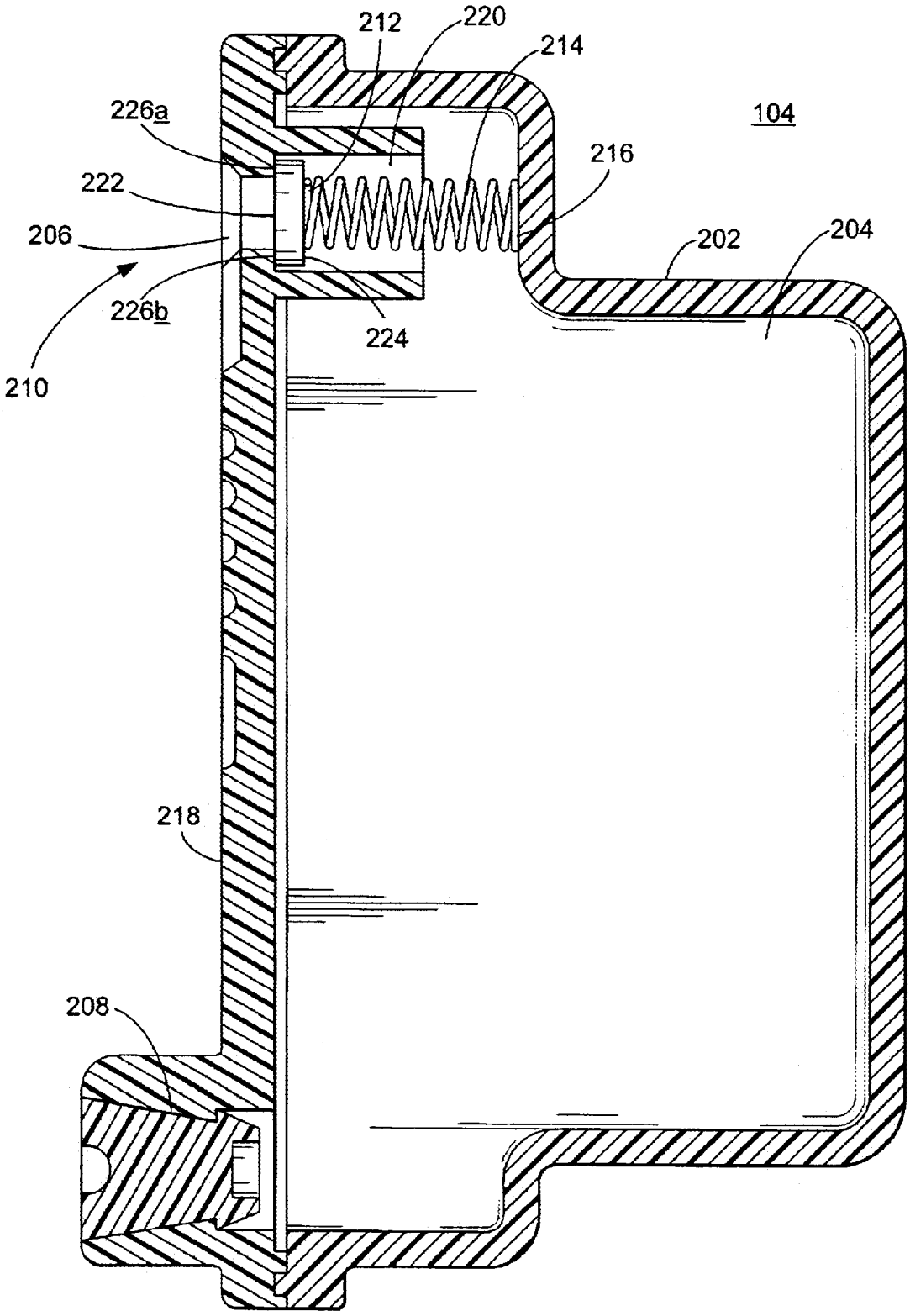
FIG. 2 is an enlarged, cross-sectional view of an exemplary ink container vessel with a vent hole in a closed position.

FIG. 2 shows a cross sectional view of an exemplary ink container vessel 104. Ink container vessel 104 includes: a chassis 202, a reservoir 204, a vent hole 206, a septum 208, and a mechanical vent system 210. Ink container vessel 104 may be designed to be releasably installed in a receiving slot (not shown) of printing system 100. It should be noted that FIG. 2 is enlarged to better aid in illustrating the vessel 104 and is not necessarily drawn to scale.

Chassis 202 is composed of a non-collapsible rigid (or semi-rigid) material and may be formed of many different shapes not limited to FIG. 2, depending on the application. For purposes of this exemplary illustration, chassis 202 is composed of rigid plastic that can either be injection molded or blow molded to enable various configurations.

Reservoir 204 is designed to store a supply of ink for delivery system 106. Reservoir 204 is internal to chassis 202 and may initially store a supply of ink up to the maximum volumetric size of reservoir 204.

Septum 208 serves as a fluid outlet for ink stored in reservoir 204. That is, ink stored in reservoir 204 is fluidly connected to septum 208. Septum 208 prevents ink from extruding from chassis 202, i.e., it acts as a sealing mechanism, when ink container 104 is out of the printer. On the other hand, when ink container 104 is installed in the printer, septum 208 allows fluidic connection between ink in reservoir 204 and ink delivery system 106; usually via tubing (not shown) or other fluid interconnections, such as a hollow needle (shown in FIG. 3 as 304). It should be noted that once vessel 104 is inserted in a printing system 100 and vent hole 206 is opened, as described below, no pressure excursion effects are incurred within reservoir 204 or vessel 104. One feature of the exemplary printing system 100 is an ink container vessel 204 that employs a vent system that imparts little-to-no flow restrictions on ink delivery systems.

Vent hole 206 is a cylindrically shaped opening through a wall 218 of chassis 202. As will be explained in more detail below, vent hole 206, when open, permits a free flow of air in and out of reservoir 204 through a labyrinth (shown in FIGS. 4 and 5). Typically, vent hole 206 is located on the upper portion of an ink container vessel 104 above the ink level in reservoir 204, but may be incorporated into any other location on vessel 104 that permits adequate air supply. The quantity of vent holes 206, their size and shape may vary, depending on the printing system, size of vessel 104 and application needs.

Mechanical vent system 210 as shown in FIG. 2 includes a sealing member 212 and compression spring 214. Sealing member 212 is a flat disk having the same cylindrical shape as vent 206, except with a larger diameter to ensure that sealing member 212 extends over vent hole 206 when sealing member 212 comes in contact with vent hole 206. Sealing member 212 could also be other shapes depending on the shape of the vent hole 206. Additionally, instead of fitting over vent hole 206, sealing member 212 could fit-in vent hole 206 to act as a plug. For instance, sealing member 212, may have a cork shape and form a seal in vent hole 206 when inserted therein.

Sealing member 212 resides in a chamber 220, which is simply an area within chassis 202 that sealing member 212 is able to move, which in this exemplary illustration is in a horizontal direction without interference. Sealing member 212 has an exterior side 222 and interior side 224. When sealing member 212 is seated against vent hole 206 (i.e., vent hole 206 is closed), exterior side 222 of sealing member 212 is in gas communication with the atmosphere through a labyrinth (to be described) and interior side 224 of sealing member 212 is either in fluid and/or gas communication with ink in reservoir 204. The exemplary sealing member 212 is constructed from a common rubber, but other elastomer or non-elastomer materials may be substituted for rubber as would be appreciated by those skilled in the relevant art.

Compression spring 214 is coupled between the interior side 224 of sealing member 212 and a housing seat 216 in chassis 202. Housing seat 216 provides a back surface for spring 214 to compress against. Compression spring 214 is disposed to resiliently press against the interior side 224 of sealing member 212. When compression spring 214 is expanded, it forces the exterior side 222 of sealing member 212 to abut against (e.g., come into contact with) vent hole 206, thereby closing vent hole 206. Although the exemplary implementation shows a compression spring 214, other compression members may be used in place of a compression spring such as an elastomer integrated with sealing member 212 and other related devices.

As shown in FIG. 2, overlapping edges 226A and 226B of sealing member 206 come into contact with the interior side of chassis 202 around vent hole 206. Accordingly, vent hole 206 is closed and sealed by the force of compression spring 214 resiliently pressing sealing member 212 with its overlapping edges 226 against the interior side of chassis 202 and sealing member's 212 coverage of vent hole 206.

It is desirable, in certain circumstances, for vent hole 206 to be closed when printing system 100 and/or ink delivery system 106 is not active. For instance, during transportation of vessel 104 itself, it is preferable that vent hole 206 is closed to prevent the ink supply in reservoir 204 from evaporating or leaking out vent hole 206. Additionally, once vessel 104 is installed into printing system 100, it may take many months to fully deplete reservoir 204 of its supply of ink. Mechanical vent system 210 through the use of compression spring 214 and sealing member 212, ensure that vent hole 206 automatically remains closed (e.g., sealing member 212 seals hole 206 from the expansion force of spring 214), when print system 100 and/or ink delivery system 106 is inactive, or vessel 104 is transported. The closure of vent hole 206 during printer inactivity or vessel transportation prevents ink from evaporating from reservoir 204 via hole 206 or leaking out during environmental fluxuations. Opening of vent hole 206 by mechanical vent system 210 shall now be described.

Figure 3:
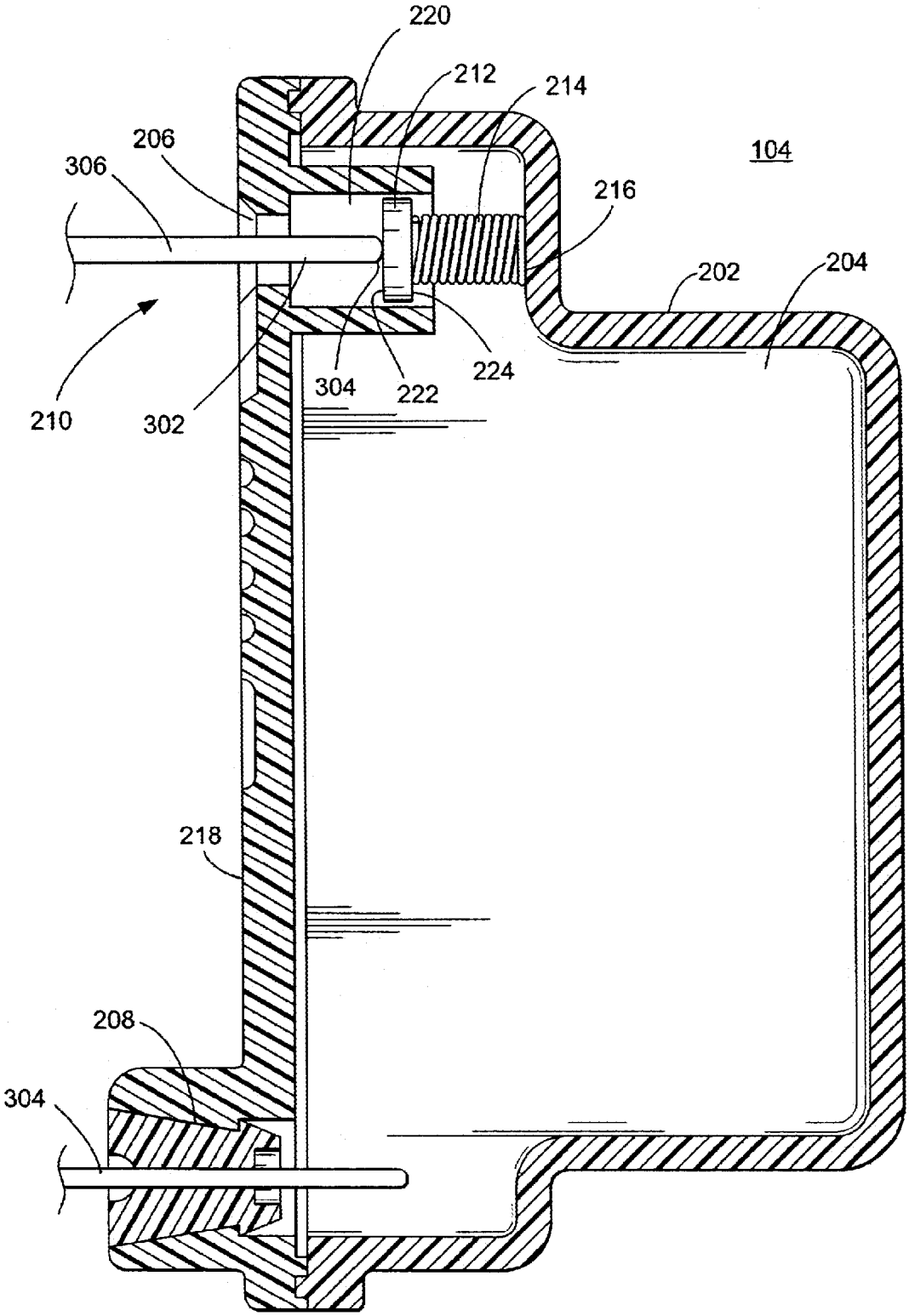
FIG. 3 is another cross sectional view of an exemplary ink container vessel with the vent hole in an open position.

FIG. 3 shows another cross-sectional view of an exemplary ink container vessel 104, with vent hole 206 opened (i.e., sealing member 212 has shifted away from vent hole 206 releasing its seal). In this exemplary Figure, mechanical vent system 210 further includes a rod (also referred to as printer pin) 302, which is shown inserted and extending through the cylindrical housing of vent 206 and chamber 220. The right end 304 of rod 302 applies a load against the exterior side 222 of sealing member 212 with a greater force than exerted by compression spring 214, forcing spring 214 to compress against the inside of chassis 202 around base 216. Accordingly, sealing member 212 moves away (i.e. shifts away) from vent hole 206, thereby opening vent hole 206.

The opening of vent hole 206 can occur at different times by different means. For example, the other end 306 of rod 302 may be in a fixed position attached (attachment not shown) to printing system 100. Accordingly, a user activates the opening of vent hole 206, by lining-up vent hole 206 with rod 302. Then a user pushes the vessel 104 against the rod 302 while simultaneously seating the vessel 104 into its receiving slot (not shown) within a printing system 100. A fixed pin enables automatic opening of vent hole 206, when the vessel is seated in a printing system 100 and automatic closing of vent hole 206 when the vessel is removed from printing system 100.

On the other hand, rod 302 may engage sealing member 212 after vessel is installed in the printer system 100 by a mechanical actuator (not shown). In this implementation, rod 302 moves in an exemplary horizontal direction to engage and push back sealing member 212. Such a dynamic rod 302 could open and close vent hole 206, when printing system 100 is active or inactive, respectively. A moveable rod 302 may be implemented as a piston. A dynamically moveable rod 302, however, would be more costly than a stationary rod of the previous implementation, because it would require additional mechanisms such as a hydraulic system. Nevertheless, for reduced costs and simplified printing system 100, a fixed stationary pin 302 is preferred.

Rod 302 is a composed of Stainless Steel, but other material including plastics could be employed. Also shown in FIG. 3, is a hollow needle 304 inserted in septum 208 to represent that vessel 104 has been inserted into printing system 100.

Figure 4:
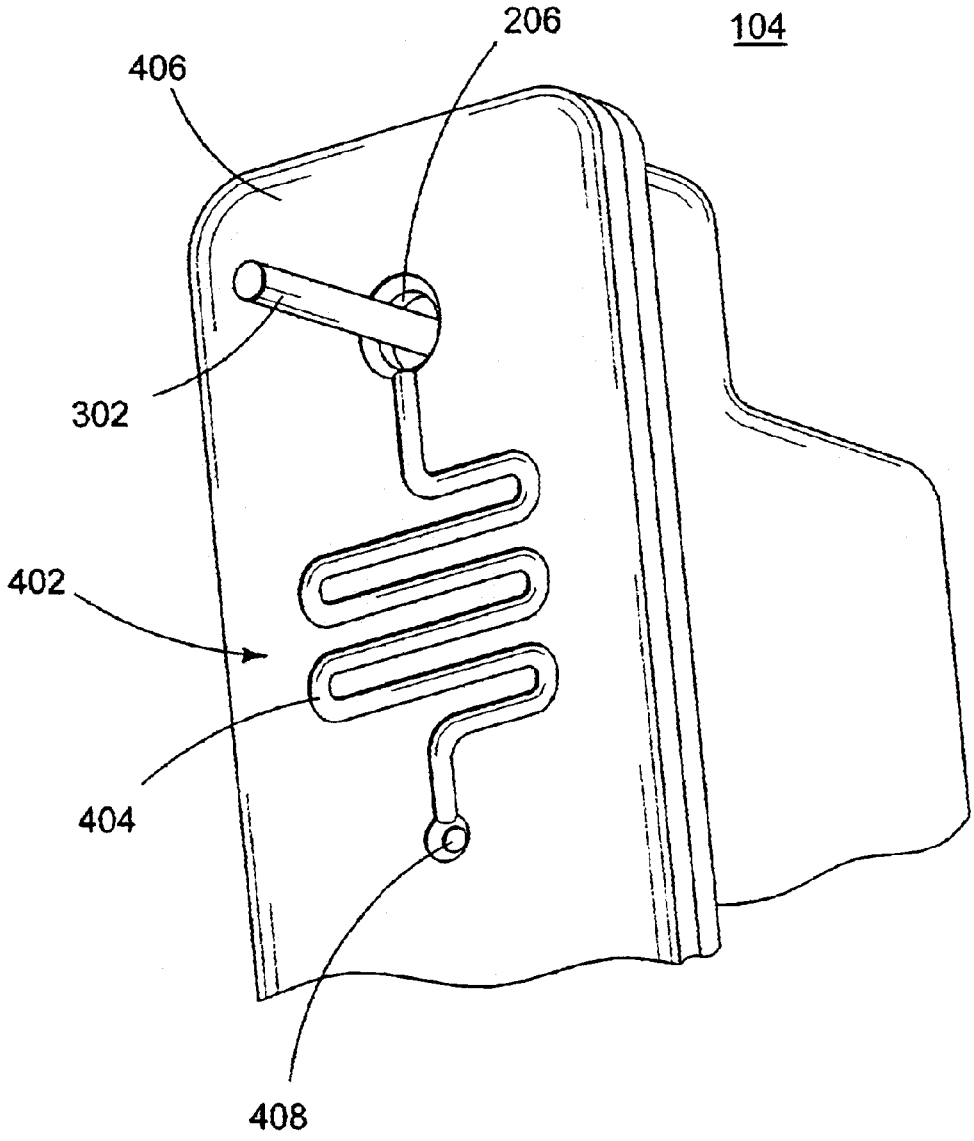
FIG. 4 is an external partial view of the exemplary vessel shown in FIGS. 2 and 3.

FIG. 4 is an external partial view of the exemplary vessel 104 shown in FIGS. 2 and 3. In this exemplary illustration, a labyrinth 402 includes a channel 404 that is molded directly into an external surface of wall 406. The exemplary channel 404 employs a laborious tortuous path linking vent hole 206 to an air flow receptacle 408. Receptacle 408 serves as a chief port for air to enter the tortuous path of channel 404, as shall become more apparent from the description below. Of course other shaped tortuous paths and channels may be employed including cylindrical paths as is well known in the art. As shown in FIG. 4, rod 302 is inserted through vent hole 206. The operation and further description of labyrinth 404 in conjunction with mechanical venting system 210 shall be described with reference to FIGS. 5 and 6 below.

Figure 5:
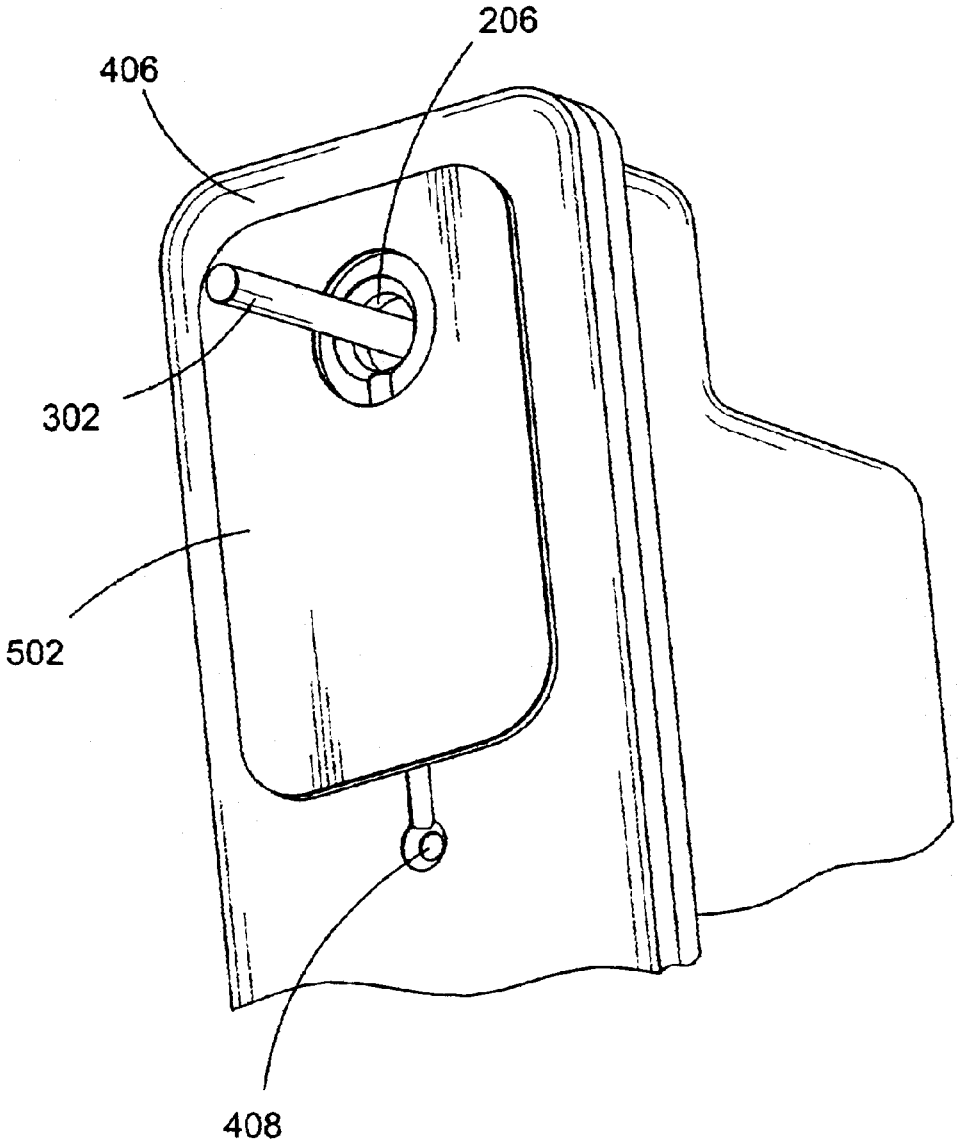
FIG. 5 is identical to FIG. 4, but shows the addition of an exemplary face plate attached to an exterior wall of vessel.

FIG. 5 is identical to FIG. 4, but shows the addition of an exemplary face plate 502 attached to wall 406 with a large portion of labyrinth 402 covered by face plate 502. A portion of channel 404 is left uncovered, which in this Figure is air receptacle 408. This permits air to travel from receptacle 408 to vent 206. Face plate 502 is made of Polypropylene film and can be attached to wall 406 by an adhesive bonding material such as pressure sensitive adhesive. Face plate 502 may be composed of other barrier materials such as reinforced aluminum foil.

To further ensure that the only path to vent hole 206 is through air receptacle 408, a seal may also be placed around vent hole 206 and rod 302, when vent 206 is open. To better illustrate one such exemplary seal, reference is made to FIG. 6, which is identical to FIGS. 2 and 3, but shows the addition of a labyrinth sealing member 602 and other exemplary elements. Any gaps between rod 302 and face plate 502 through vent hole 206 is completely covered and sealed by a labyrinth seal 602. A labyrinth compression spring 606 provides a load against labyrinth seal 602 forcing the seal 602 against wall 406. Two identical plates 604A, 604B provide a means for labyrinth compression spring 606 to press firmly against labyrinth seal 602. Plates 604 distribute the force of labyrinth compression spring 606 to labyrinth seal 602. Labyrinth compression spring 606 is attached to a printer chassis (not shown) on the opposite end of rod 302. The printer chassis provides a back surface for the labyrinth compression spring 606 to compress against.

Additionally, labyrinth seal 602 is fixed around the circumference of rod 302 in a hermetic fashion. The exemplary labyrinth seal 602 is disk shaped with added thickness around the rod 302. Accordingly, when labyrinth seal 602 is in place, the only air communication with vent 206 is through air receptacle 408 shown in FIGS. 4 and 5. Labyrinth seal 206 is preferably made of a common rubber material, but other elastomer or non-elastomer materials may be substituted for rubber as would be appreciated by those skilled in the relevant art. The size, thickness and shape may of labyrinth seal vary, depending on the size of rod 302, vent hole 206 and labyrinth 402. All such considerations, however, are well within the purview of a person skilled in the relevant art.

Figure 6:
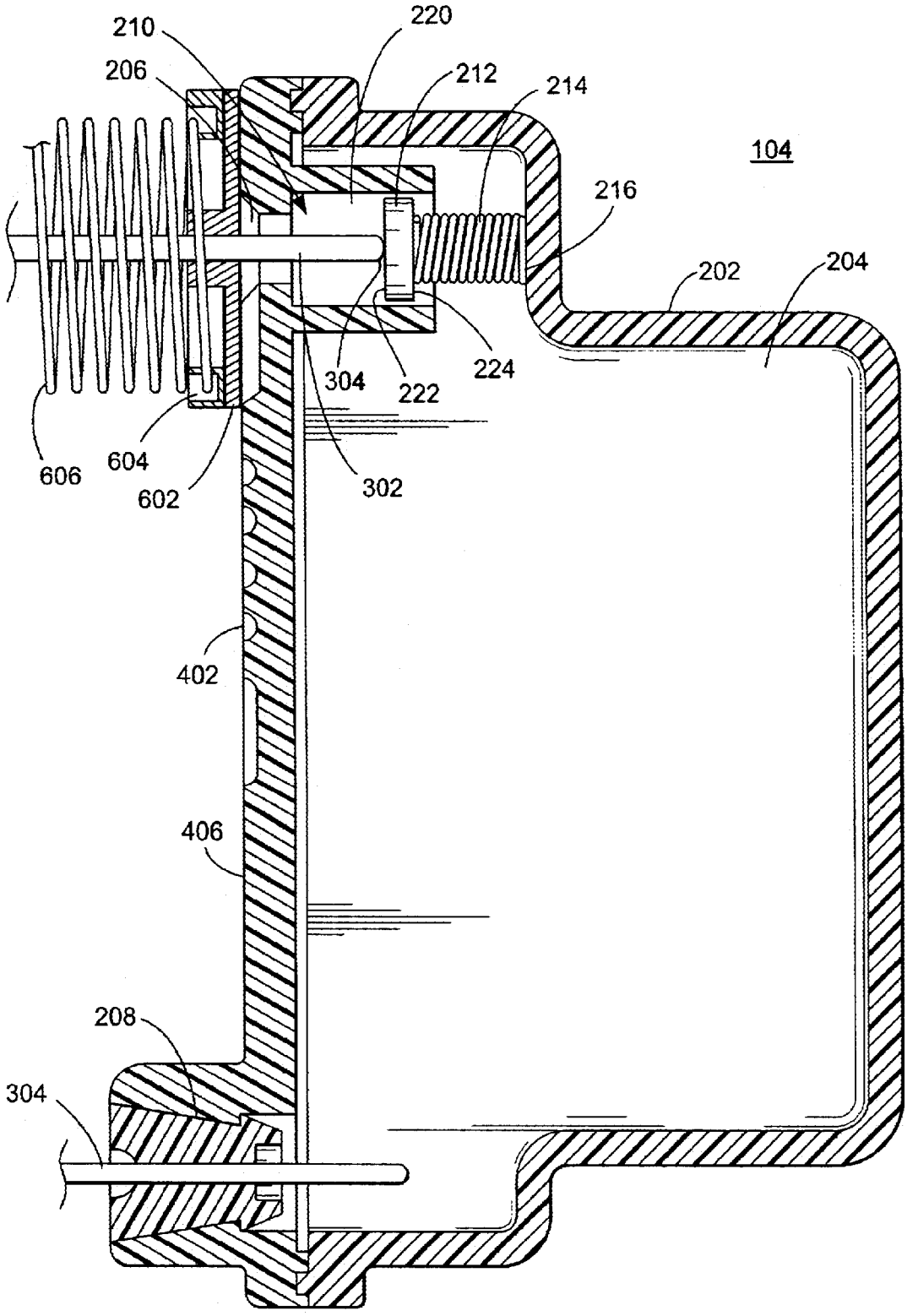
FIG. 6 is identical to FIGS. 2 and 3, but shows the addition of a labyrinth sealing member as well as other elements associated with sealing the vent hole from the exterior of the vessel when a rod is inserted in the vent hole.

When vessel 104 is inserted in a printing system 100 and vent hole 206 is open as shown in FIG. 6, air flow communication is actuated between reservoir 204 and the atmosphere, via labyrinth 402. Additionally, labyrinth 402 aids in preventing ink evaporation once vent 206 is opened by mechanical vent system 210.

Another feature of the exemplary printing system 100 described above is an exemplary ink container vessel 104, in which environmental pressures imparted within the reservoir of the vessel, can be virtually eliminated by the exemplary mechanical vent system 210 in conjunction with vent hole 206.

Still another feature of the exemplary printing system 100 is the ability to employ "free-ink" (that is, without the use of porous, absorbent, or solid materials in the reservoir 204, such as foam mentioned in the Background Section above)

container vessels 104, which enables the highest volumetric efficiency for ink storage, while simultaneously providing for a greater variety of container shapes than non-"free-ink" vessels. Free-ink vessels 104 are also friendlier to the environment than conventional ink vessels, which are not recyclable and often leak ink into the environment once discarded.

Yet another feature of the exemplary printing system 100 is a tremendous reduction of stranded ink. Ink containers employing the inventive concepts described above typically strand less than three percent of the total initial fill volume of the ink container, which is between 5-to-16 times better than current porous media and film containers. The placement of the fluid port at substantially the lowest point of the fluid reservoir further serves to reduce stranded ink. A free ink container fills the available space, thus having nearly 100% volumetric efficiency and it can have very low stranded ink, therefore providing the end user with the maximum value in printing consumables. Another significant advantage of the present invention is that during ink fill there need be no concern of leaving air in the container and therefore the ink fill can occur through one or both of the interconnects. This allows for a much faster ink fill, which is a significant manufacturing advantage.

A further feature of the present invention is the placement of the fluid interconnect port and the vent port on the same face of the container, with both both interconnections occurring during the installation of the ink container into the printer. This arrangement enables manufacturing technology such as blow molding, which is very low cost and very flexible in the shapes that can be generated.

Thus, although some preferred implementations of the various methods and arrangements of the present invention have been illustrated in the accompanying Drawings and described in the foregoing Detailed Description, it will be understood that the invention is not limited to the exemplary aspects disclosed, but is capable of numerous rearrangements, modifications and substitutions without departing from the spirit of the invention as set forth and defined by the following claims.

What is claimed is:

1. A printing system, comprising:

an ink container vessel having a reservoir to store a supply of ink, said ink container vessel having a vent hole to permit atmospheric air to enter said reservoir;

an ink delivery system, coupled to said vessel, configured to extract ink from said vessel; and a mechanical vent system coupled to said vent hole comprising:

(a) a sealing member having an interior and exterior side;

(b) a compression member, coupled to said interior side of said sealing member, configured to resiliently press against said interior side of said sealing member, to bias said sealing member toward said vent hole thereby closing said vent hole when said compression member is expanded; and (c) a rod, extending through said vent hole to apply a load against said exterior side of said sealing member, thereby forcing said compression member to move and shift said sealing member away from said vent hole, thereby opening said vent hole.

2. The printing system of claim 1, wherein said sealing member is an elastomer disk that fits over said vent hole forming a seal when closed and wherein said interior side faces said supply of ink when closed and said exterior side faces atmospheric air.

3. The printing system of claim 1, wherein said mechanical vent system is configured to open said vent hole when said printing system is active and close said vent hole when said printing system is inactive.

4. The printing system of claim 1, wherein said mechanical vent system is configured to open said vent hole when said container vessel is inserted into printing system and close said vent hole when said vessel is removed from said printing system.

5. The printing system of claim 1, further comprising a labyrinth channel molded into an exterior surface of said vessel to provide an air flow communication path with said vent hole and wherein said compression member is a compression spring.

6. The printing system of claim 1, further comprising a labyrinth channel molded into an exterior surface of said vessel to provide an air flow communication path with said vent hole and further comprising a face label covering most of said labyrinth channel.

7. The printing system of claim 1, further comprising:

a labyrinth channel molded into an exterior surface of said vessel to provide an air flow communication path with said vent hole;

a face label covering most of said labyrinth channel; and a labyrinth sealing member forming a seal around said rod and said vent hole.

8. An ink container vessel configured to supply ink to a printing system, the ink container vessel comprising:

a reservoir configured to store a supply of ink;

a vent hole located in said vessel providing an opening to said reservoir;

a mechanical vent system configured to close and open said vent hole comprising:

(a) a sealing member having an interior side and an exterior side;

(b) a compression member, coupled to said interior side of said sealing member, configured to resiliently press against said interior side of said sealing member, to bias said sealing member toward said vent hole thereby closing said vent hole when said compression member is expanded; and (c) a rod, insertable to extend through said vent hole opposite said compression member and push said exterior side of said sealing member with a force opposite and greater than exerted by said compression member on said interior side of said sealing member, forcing said compression member to move and shift said sealing member away from said vent hole, thereby opening said vent hole.

9. The ink container vessel of claim 8, wherein said sealing member is an elastomer disk that fits over said vent hole forming a seal when closed and wherein said compression member is a compression spring.

10. The ink container vessel of claim 8, wherein said mechanical vent system is configured to open said vent hole when said printing system is active and close said vent hole when said printing system is inactive.

11. The ink container vessel of claim 8, wherein said mechanical vent system is configured to open said vent hole when said container vessel is inserted into printing system and close said vent hole when said vessel is removed from said printing system.

12. The ink container vessel of claim 8, further comprising a labyrinth channel molded into an exterior portion of said wall providing an air flow communication path with said vent hole.

13. The ink container vessel of claim 8, further comprising a labyrinth channel molded into an exterior portion of said wall providing an air flow communication path with said vent hole and further comprising a face seal covering most of said labyrinth channel.

14. The ink container vessel of claim 8, further comprising a labyrinth channel molded into an exterior portion of said outer wall of said vessel providing an air flow communication path with said vent hole and further comprising a face seal covering most of said labyrinth channel and further comprising a labyrinth sealing member forming a seal around said rod and said vent hole.

15. A free ink container for supplying ink to an inkjet printing system, said container comprising:

a reservoir configured to store a supply of ink;

a vent hole providing an opening into said reservoir through said container;

a mechanical vent system configured to close and open said vent hole comprising:

(a) a sealing member having an interior and exterior side;

(b) a movable member, coupled between said interior side of said sealing member and said interior side of said reservoir, configured to resiliently press against said sealing member forcing said exterior side of said sealing member to cover said vent hole thereby closing said vent hole when said movable member is expanded; and (c) a rod, insertable to extend through said vent hole and push against said exterior side of said sealing member, thereby forcing said movable member move away from said vent hole thereby uncovering said vent hole;

a labyrinth located on an exterior surface of said container, having a channel in air communication with said vent hole.

16. The container of claim 15, further comprising a face plate covering said labyrinth, but leaving at least one an end of said channel, furthest from said vent, uncovered.

17. The container of claim 15, further comprising a labyrinth seal large enough to seal said vent hole on said exterior surface of said container and said rod inserted therein.

18. The container of claim 15, further comprising a labyrinth seal large enough to seal said vent hole on said exterior portion of said wall of said vessel and said rod inserted therein, wherein said labyrinth seal is pressed against said exterior portion of said wall by a labyrinth compression spring.

19. The container of claim 15, wherein said mechanical venting system permits air to enter said channel when environmental changes cause air volume in said reservoir to expand beyond said reservoir, by opening said vent hole and preventing pressure from fluctuating in said reservoir.

20. The container of claim 15, wherein said mechanical venting system automatically prevents ink from leaking from said vent hole, by closing said vent hole when said vessel is removed from said printing system.

* * * * *